US012060219B2

(12) United States Patent
Boss et al.

(10) Patent No.: US 12,060,219 B2
(45) Date of Patent: Aug. 13, 2024

(54) CAPSULE FOR FOOD OR BEVERAGE PREPARATION HAVING A DISPLACEABLE MEMBRANE FOR ENGAGEMENT WITH OPENING MEANS

(71) Applicant: SOCIETE DES PRODUITS NESTLE S.A., Vevey (CH)

(72) Inventors: Christophe Boss, Lausanne (CH); David Nordqvist, Echichens (CH)

(73) Assignee: Societe des Produits Nestle S.A., Vevey (CH)

( * ) Notice: Subject to any disclaimer, the term of this patent is extended or adjusted under 35 U.S.C. 154(b) by 203 days.

(21) Appl. No.: 17/413,083

(22) PCT Filed: Dec. 10, 2019

(86) PCT No.: PCT/EP2019/084323

§ 371 (c)(1),
(2) Date: Jun. 11, 2021

(87) PCT Pub. No.: WO2020/120432

PCT Pub. Date: Jun. 18, 2020

(65) Prior Publication Data

US 2022/0024684 A1 Jan. 27, 2022

(30) Foreign Application Priority Data

Dec. 12, 2018 (EP) ..... 18211863

(51) Int. Cl.
*B65D 85/804* (2006.01)

(52) U.S. Cl.
CPC ..... *B65D 85/8052* (2020.05)

(58) Field of Classification Search
CPC ..... B65D 85/804–8067
See application file for complete search history.

(56) References Cited

U.S. PATENT DOCUMENTS 4,948,018 A * 8/1990 Tansley ..... B65D 85/8052 215/250
2004/0228955 A1* 11/2004 Denisart ..... B65D 85/8046 426/590

(Continued)

FOREIGN PATENT DOCUMENTS

CN 1612831 A 5/2005
CN 103189284 A 7/2013

(Continued)

*Primary Examiner* — Drew E Becker
*Assistant Examiner* — Chaim A Smith
(74) *Attorney, Agent, or Firm* — K&L Gates LLP

(57) ABSTRACT

The invention relates to a capsule (1) for food or beverage preparation comprising a hollow body (2) and an injection wall (4) to be punctured for fluid injection into the capsule, a chamber (10) formed inside the body containing an ingredient, a membrane (9) disposed at a bottom end of the chamber, and opening means (15) disposed outside the chamber (10) in the vicinity of the membrane (9). The opening means (15) are configured to open the membrane (9) when said membrane (9) is pressed against said opening means (15) under an opening pressure. The membrane is attached to the body (2) of the capsule by an adhesive seal (11) which provides sealing between the body (2) and the membrane (9). When a release pressure is established inside the chamber (10), the adhesive seal bead (11) allows the membrane (9) to be displaced relatively to the body (2) and to engage against the opening means (15) while it maintains an attachment between the membrane and the capsule body (2).

13 Claims, 2 Drawing Sheets

(56) References Cited

U.S. PATENT DOCUMENTS

| | | | | |
|---|---|---|---|---|
| 2012/0070543 | A1 | 3/2012 | Mahlich | |
| 2015/0232263 | A1* | 8/2015 | Talon | B65D 65/38<br>426/115 |
| 2015/0314954 | A1 | 11/2015 | Empl | |

FOREIGN PATENT DOCUMENTS

| | | | |
|---|---|---|---|
| JP | 2012530537 | A | 12/2012 |
| WO | 2006021405 | | 3/2006 |
| WO | 2011159163 | A1 | 12/2011 |
| WO | 2016135581 | | 9/2016 |

* cited by examiner

--PRIOR ART--

--PRIOR ART--

--PRIOR ART--

CAPSULE FOR FOOD OR BEVERAGE PREPARATION HAVING A DISPLACEABLE MEMBRANE FOR ENGAGEMENT WITH OPENING MEANS

CROSS REFERENCE TO RELATED APPLICATIONS

The present application is a National Stage of International Application No. PCT/EP2019/084323, filed on Dec. 10, 2019, which claims priority to European Patent Application No. 18211863.8, filed on Dec. 12, 2018, the entire contents of which are being incorporated herein by reference.

FIELD OF THE INVENTION

The present invention concerns the field of food or beverage capsules comprising a hollow body which contains an ingredient for food or beverage preparation. In the field of food or beverage preparation, it is known to use single-serve capsules for mixing an ingredient contained in said capsule, with a fluid fed from a pressurized source contained in a food or beverage preparation machine. More particularly, such capsules are adapted for preparation of a food or beverage preparation by dissolution into the fluid or extraction by the fluid under a preparation pressure. This includes preparation of coffee (in such case, the ingredient is ground roast coffee to be extracted with water vapour and/or hot liquid water), and soluble ingredients or a mix of soluble ingredients for preparation of a beverage such as instant coffee, hot chocolate, or a soup or other dehydrated edible product to be dissolved with hot or cold water or milk.

BACKGROUND OF THE INVENTION

The principle of extracting and/or dissolving the contents (i.e. ingredients) of a closed capsule under pressure is known, and consists typically of inserting the capsule into a receptacle or cavity of a machine, injecting a quantity of pressurized water or other adapted fluid into the capsule, generally after piercing a face of the capsule with a piercing injection element such as a fluid injection needle mounted on the machine, so as to create a pressurized environment inside the capsule either to extract the substance or dissolve it, and then release the extracted substance or the dissolved substance through the capsule.

Capsules have been developed for such an application of food preparation, and in particular for beverage preparation, which are described and claimed in applicant's European patent EP 1784344 B1, or in European patent application EP 2062831.

In short, such capsules comprise typically:

- a hollow body and an injection wall which is impermeable to liquids and to air and which is attached to the body (or made integral with the body) and adapted to be punctured by e.g. an injection needle of the machine,
- a chamber containing a bed of ground roast coffee to be extracted, or a soluble ingredient or mix of soluble ingredients,
- a membrane, usually made of aluminium, disposed at the bottom end of the capsule and attached to the body.

The membrane closes the chamber, for retaining the internal pressure in the chamber when pressurised fluid is introduced into the capsule.

The opening of the chamber for beverage delivery is achieved by increasing the pressure within the chamber. This pressure is increased by introducing a quantity of pressurized fluid such as water into the chamber. When the internal pressure is sufficient, the membrane is opened upon contact with opening means. The present invention relates to a capsule having the opening means within the capsule, or in other words a capsule which comprises its own opening means activated by the rise of pressure of the fluid introduced into the capsule at the time of beverage extraction. This type of capsule is disclosed for example in European patent application EP 1472156. Opening means are disposed within the capsule, outside the chamber, in the vicinity of the membrane. When a sufficient pressure is established inside the chamber, the membrane tends to be pressed against said opening means, and is cut or teared, and thus opened. The beverage flows through the openings thus produced.

The opening means are for example formed by a so-called "pyramid plate" comprising raised and recessed elements. The membrane engages the raised and recessed elements of the pyramid plate under the effect of the rise of pressure in the chamber of the capsule until it tears open.

In such capsules a compromise has to be found regarding the membrane. On one hand, it has to be stiff enough to allow the pressure to rise inside the chamber up to the desired level, but on the other hand the membrane has to be stretched to correctly engage with the opening means.

As a consequence, although the current design gives good results, it could be optimized because the way the capsules open is not perfectly regular and not reproducible from one capsule to another.

The present invention thus relates to a capsule for food or beverage preparation which addresses the above mentioned problem.

SUMMARY OF THE INVENTION

According to the invention, there is provided a capsule for food or beverage preparation, the capsule comprising:

- a hollow body and an injection wall which is impermeable to liquids and to gases and which is attached to the body and adapted to be punctured for fluid injection into the capsule,
- a chamber formed inside the body containing an ingredient for preparing food or beverage by dissolution with the fluid under pressure or extraction by the fluid under a preparation pressure,
- a membrane disposed at a bottom end of the chamber, for retaining internal pressure in the chamber,
- opening means disposed outside the chamber in the vicinity of the membrane, the opening means being configured to open the membrane when said membrane is pressed against said opening means under an opening pressure. The membrane is attached to the body of the capsule by an adhesive seal which, when a release pressure, less than the opening pressure, is established inside the chamber and applied to at least part of the surface of the membrane, is configured to allow the membrane to be displaced relatively to the body and to engage against the opening means while maintaining an attachment between the body and the membrane.

The capsule according to the invention thus allows a slight movement of the membrane with respect to the body of the capsule when a sufficient force is applied to the membrane by the pressure inside the chamber. Compared to the prior art, the membrane is not only deformed to engage with the opening means, it is also displaced against said opening means.

This displacement is possible thanks to the configuration of an adhesive seal interposed between the membrane and the body, typically between the edge portion of the membrane and a rim formed around an opening formed at the bottom of the chamber of the capsule. The adhesive seal attaches the membrane to the capsule body and provides a fluid-tight seal between the membrane and the body. The adhesion provided by the adhesive seal bead is sufficient to keep the membrane reliably fastened to the capsule body when the pressures inside and outside the membrane are substantially balanced (during shelf-life, the pressure inside the capsule can be slightly higher than atmospheric pressure). However, when a sufficient pressure referred to as release pressure is established inside the chamber, the adhesive seal has adhesive properties which are not sufficient to sustain the force applied on the membrane due to the pressure difference between the inside and the outside of the chamber. This causes a displacement of the membrane, but the attachment between the membrane and the capsule body is maintained so that the chamber remains closed until the membrane is opened by the opening means under an opening pressure that is higher than the release pressure. Such displacement ensures that the membrane correctly engages the opening means before it is torn open, making it possible to obtain a more predictable and reproducible opening. Maintaining the sealing despite displacement of the membrane avoids the chamber being opened before the opening pressure is reached.

The configuration of the adhesive seal to allow the membrane to be displaced under the release pressure can in particular be based at least on the following parameters: the adhesive seal composition, the adhesive seal contact area between the membrane and the body of the capsule, the area of the part of the membrane to which pressure applies when a pressure is established in the chamber.

The adhesive seal is preferably a heat seal lacquer. The seal lacquer can be composed of a polymer material or polymer materials. For example, the polymer material is selected from the group consisting of polypropylene (PP), polystyrene (PS), polyethylene terephthalate (PET), and vinyl (PVC).

The adhesive seal has can have a tear resistance comprised between 4N/15 mm and 12N/15 mm, measured according to ISO 1924/1 standard.

The release pressure can be set between 1 and 12 bar, for example about 5 bar. The opening pressure can be 0.5 to 10 bar above the release pressure.

The adhesive seal material can be chosen from known materials used in the food industry. The desired release pressure and opening pressure can be determined based on the beverage or food product to be prepared. It is important to reach this pressure in order for the substance to be extracted and a good-quality beverage to be formed. The opening pressure mainly depends on the characteristics of the membrane and of the opening means. The release pressure depends on the configuration of the seal, including the material it is made of, its shape (form and dimensions, etc.), and on the surface area of the membrane to which the internal pressure of the chamber applies to generate the force which pushes said membrane outside the chamber.

The material of which the membrane is made can have a Young's modulus above 10 GPa, preferably above 30 GPa. The membrane can for example be made of aluminium.

The Young's modulus of aluminium is around 69 GPa. A high Young's modulus of the membrane promotes the pressure rise in the chamber. However, this limits the ability of the membrane to deform before it is torn open. The invention makes it possible to use very stiff (non-elastic) membranes while a correct engagement of the membrane with the opening means can be reliably obtained.

The opening means can comprise (or be constituted by) a plate having an upper surface facing the membrane, and the upper surface forms or carries sharp elements. The sharp elements may be pyramids or truncated pyramids.

A plate having an upper surface carrying truncated pyramids or other sharp puncturing elements provides an advantageous configuration because such a surface acts as a pressure-spreading means and has the effect of allowing the pressure of the fluid to rise sufficiently inside the capsule before puncturing (and opening) of the membrane occurs.

The material of which the chamber is formed is selected from the group consisting of aluminum, aluminum/plastics composite, aluminum/plastics/paper composite, paper laminates, and plastics in a single layer or in a multilayer form.

The ingredient contained in the chamber can comprise ground roast coffee to be extracted with water vapour and/or hot liquid water or can comprise a soluble ingredient or mix of soluble ingredients for preparation of a beverage such as instant coffee, hot chocolate, or a soup or other dehydrated edible product to be dissolved with hot or cold water or milk.

BRIEF DESCRIPTION OF THE DRAWINGS

Additional features and advantages of the present invention are described in, and will be apparent from the description of the presently preferred embodiments which are set out below with reference to the drawings in which.

DETAILED DESCRIPTION OF THE INVENTION

Figure 1:
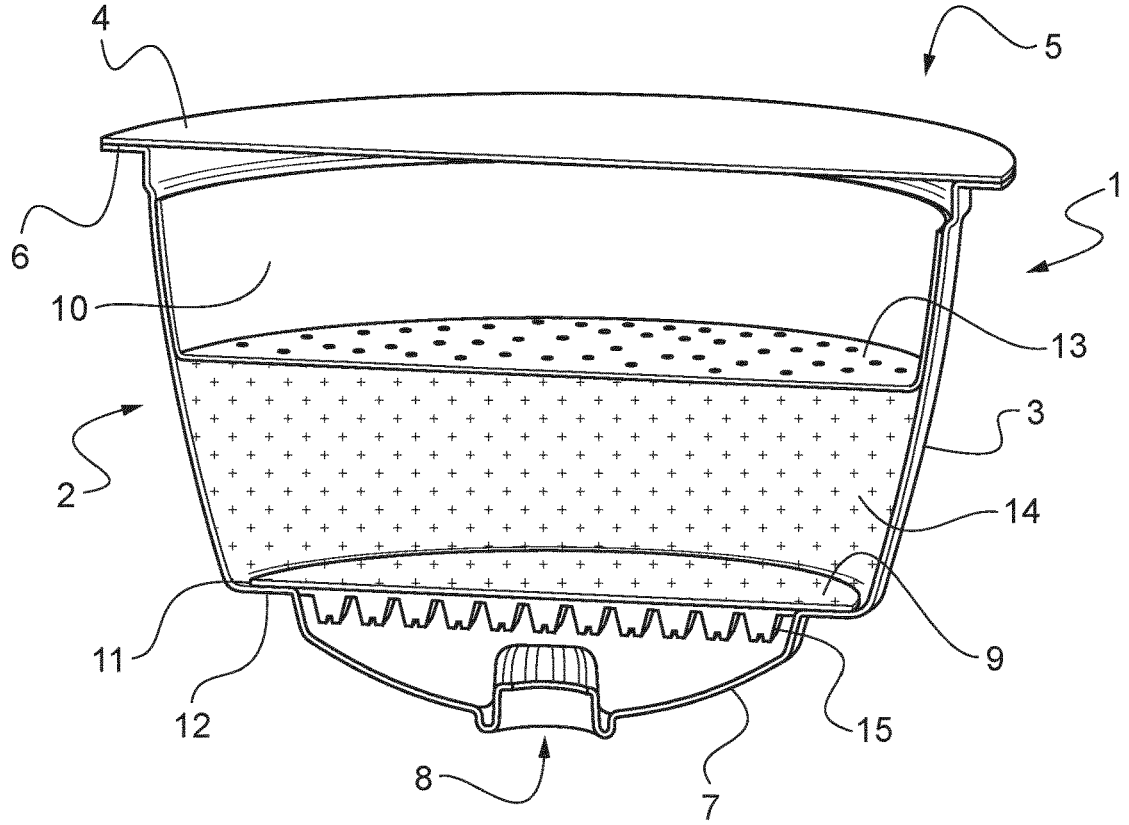
FIG. 1 is a schematic perspective view in cross-section of a capsule for food or beverage preparation.

The capsule 1 of FIG. 1 comprises a capsule body 2 made of capsule walls 3. In the represented embodiment, the capsule body walls 3 have a substantially frusto-conical shape The capsule walls 3 can be made of different materials. They can be made of aluminium, aluminium/plastics composite, or aluminium/plastics/paper composite. They can be made of a rigid or semi-rigid thermoplastics such as a polypropylene or polyethylene. Plastics can be in a single layer or in a multilayer form. The capsule body can for example also be made of any suitable type of impermeable material such as coated paper, coated cardboard, other materials containing cellulosic fibres, or starch for instance, metal or alloy, glass, synthetic or natural rubber or elastomer, or a combination thereof. Preferably, materials will be chosen from cost-effective and ecologic material, e.g. biodegradable material, having barrier properties, preferably at least against moisture and oxygen.

Depending on the material used, the manufacturing process can be thermoforming or injection. It can also involve in-mould labelling, for instance in order to provide the capsule with specific barrier properties by using a film label with moisture and oxygen barrier properties. Such an in-mould labelling process for making a capsule is generally described in the applicant's European patent publication EP 2559636 A1. The moisture and oxygen barrier properties of the container walls can be achieved with any kind of suitable material such as barrier thermoplastics films having single or multiple layers, or aluminium, or paper, or a combination thereof. The capsule body walls 3 comprise upper and lower openings.

The upper opening of the capsule body is closed by an upper injection wall 4 forming the top face 5. The upper injection wall 4 can be welded on upper peripheral edges 6 of the capsule body walls 3.

The capsule 1 further comprises a bottom wall 7 having a dispensing opening 8. It further comprises a pierceable membrane 9, preferably made of aluminium. The membrane 9 is attached to the capsule body 2. A chamber 10 is thus formed within the body 2, delimited by the body walls 3, the injection wall 4, and the membrane 9.

The membrane 9 is attached to the body 2 by an adhesive seal 11. The adhesive seal 11 provides sealing between the body 2 and the membrane 9.

More particularly, the chamber 10 is closed at its bottom end by the membrane 9, the bottom end of the chamber 10 comprising an opening closed by said membrane 9. The opening at the bottom end of the chamber 10 is surrounded by a rim 12. The rim 12 extends in a plane parallel to the top face 5 of the capsule, and provides a flat surface for fastening the membrane 9. The adhesive seal 11 is interposed between said rim 12 and a periphery of the membrane 9.

The capsule 1 of the represented example embodiment further comprises a distributor wall 13 that is located between said injection wall 4 and a capsule lower compartment 14.

Preferably, the ingredient contained in the capsule is located in the interior compartment 14, i.e. in the portion of the capsule chamber 10 which is between the distributor wall 13 and the bottom membrane 9.

However, it is also possible to dispose the same ingredient throughout the whole volume of the chamber 10, or alternatively, two different ingredients can be separated from one another by the distributor wall 13.

The distributor wall 13 comprises through-holes. Their diameter is appropriately chosen depending on the type of ingredient contained in the capsule and on the corresponding type of product preparation. If the distributor wall comprises a single hole, the flow of fluid through said hole will create a single jet, with a powerful mixing effect. This configuration is preferably chosen in case the ingredient contained in the capsule is a soluble powder, which requires a powerful swirling movement of the water injected therein, so as to improve the dissolution of the powder with the water. Alternatively, for example if the ingredient contained in the capsule compartment is ground roast coffee, the distributor wall 13 comprises a plurality of holes, distributed evenly across its surface to ensure proper wetting of the coffee bed contained between the distributor wall 29 and the bottom wall 32 of the capsule.

The diameter of the holes is preferably less than the smallest particles of the ingredient, but it is sufficient to ensure a proper flow of water through the rigid distributor wall 13. The diameter can for example be comprised typically between 10 microns and 3 mm, preferably between 100 microns and 1 mm.

Between the membrane 9 and the bottom wall 7, opening means 15 are provided. The opening means 15 has the general shape of a plate, the upper face of said plate facing the membrane 9 and being disposed inside the capsule body 2 in the vicinity of the membrane 9. The upper face of the plate of the opening means forms sharp elements adapted to pierce or tear the membrane 9 when fluid pressure inside the capsule compartment increases thus engaging the membrane with the opening means 15 and pressing said membrane against said opening means.

Figure 2:
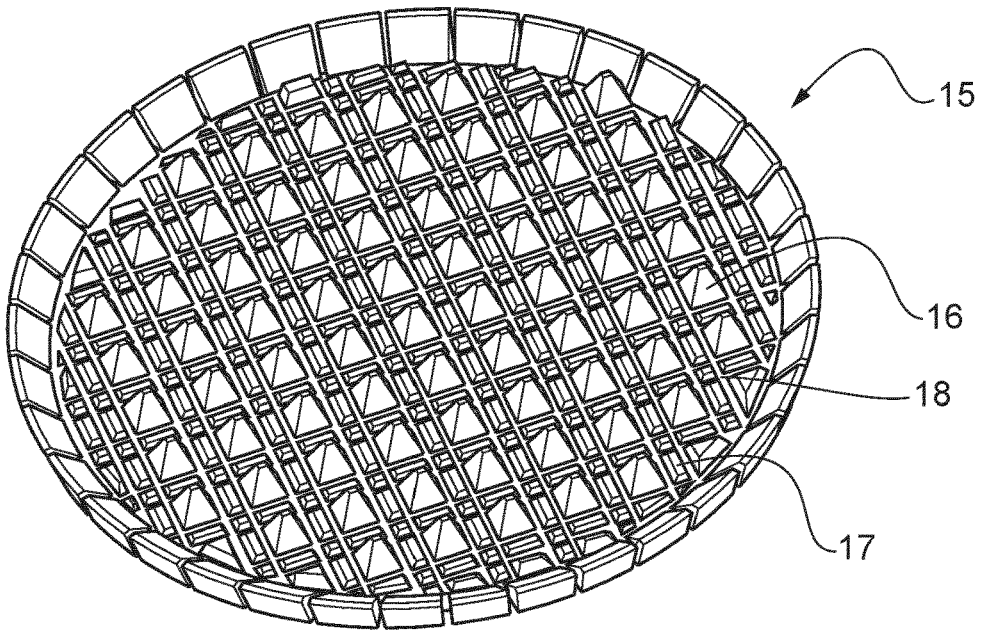
FIG. 2 is a schematic perspective view of a pyramid plate which constitutes opening means that can be used in a capsule according to the invention.

FIG. 2 is a detailed perspective view of an example embodiment of the opening means 15, corresponding to the opening means used in the capsule of FIG. 1. The upper face the opening means 15 is shown in FIG. 2. According to this embodiment the opening means 15 for opening the membrane 9 consist of a disc with recessed and raised elements 16. The recessed and raised elements 16 have a pyramid-shape (more precisely a slightly truncated pyramid shape). In other embodiment, the recessed and raised elements have any other geometry adapted to open the membrane, such as a cone shape. Smaller raised elements 17 are also arranged in spaces 18 between the pyramidal raised elements 16.

The plate comprises holes preferably formed in the spaces 18 between the pyramidal raised elements 16 (e.g. at the top of said smaller raised elements) so as to let the product formed by dissolution or extraction inside the compartment 14 out towards a consumer's cup when the membrane 9 is opened.

As the membrane engages and is pressed against the upper face of the opening means, the membrane has also a filter function for the prepared beverage.

However, the membrane has to be stiff enough to allow the pressure to rise inside the chamber up to the desired level. That is why aluminium, which is also compatible for food contact, is generally used. At the same time, the membrane has to correctly engage with the opening means, and in particular it has to be deformed and stretched to conform to the pyramid surfaces (or the surfaces of other opening elements) to provide, in a reproducible way, predictable opening such as holes or tears evenly distributed over the surface of the membrane.

Figure 3A:
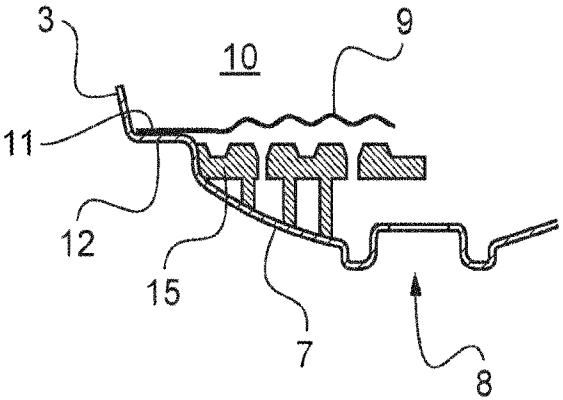
FIGS. 3*a* to 3*c* are schematic partial cross-section views of a capsule which illustrate the behaviour of a membrane of a capsule according to the prior art.
Figure 3B:
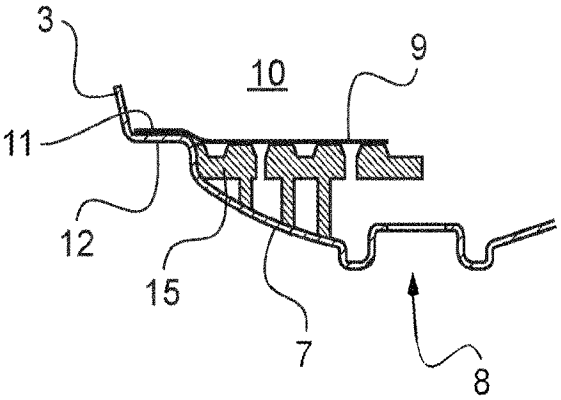
Figure 3C:
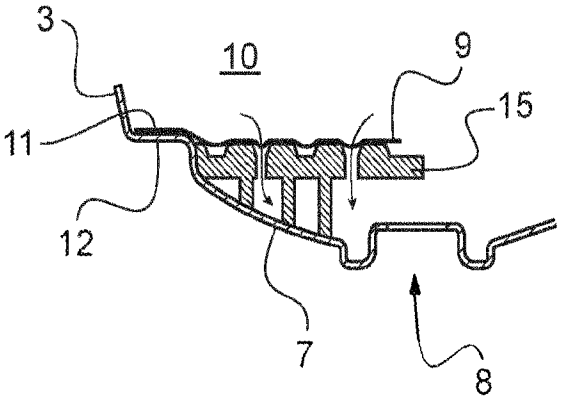

FIGS. 3*a*, 3*b* and 3*c* illustrate the behaviour of a membrane of a capsule according to the prior art when a food or beverage product is produced.

FIG. 3*a* represents the bottom end portion of a capsule for food or beverage preparation, before injection of fluid inside the chamber 10. The membrane 9 is attached to rim 12 formed by the walls 3 of the body 2 by the adhesive seal 11. As the pressure is balanced between the interior of the capsule (chamber 10) and the exterior of the capsule, no force due to a pressure difference is applied to the membrane 9. In this state, the exterior surface of membrane 9 (face of the membrane outside the chamber 10) faces the opening means 15 in the vicinity of an upper face of said opening means 15.

In FIG. 3*b*, fluid, typically water and/or water vapour is introduced under pressure (i.e. above atmospheric pressure) into the chamber 10 formed within the capsule body 2. The pressure rises inside the chamber 10. The pressure is applied to the body walls 3 and to the membrane 10. More particularly, the pressure is applied to the part of the membrane 9 which closes the opening surrounded by the rim 12. The pressure difference between the interior of the capsule (chamber 10) and the exterior of the capsule, in particular under the membrane 9, generates a force distributed over the membrane surface area which closes the opening surrounded by the rim 12. This force pushes the membrane 9 in a direction from inside to outside the chamber 10. The membrane 9 engages the opening means 15. As shown in FIG. 3*b*, because the membrane is made of a stiff material such as aluminium, the deformation of the membrane 9 is limited. More particularly, the increase of the membrane surface area, i.e. the ability of the membrane to be stretched before it tears, is limited. The membrane thus conforms only to the top part of some of the raised elements of the opening means.

The pressure rises in the chamber 10 with introduction of fluid until it reaches a so-called opening pressure. With the pressure rise inside the chamber the membrane is pressed against the opening means by the force generated by the pressure difference between the pressure inside the chamber 10 and the atmospheric pressure outside said chamber 10. When the opening pressure is reached, the membrane opens (i.e. is pierced, cut, or torn) as shown in FIG. 3*c* thanks to the sharp design of raised elements 16 of the opening means 15. The food or beverage product obtained flows through the membrane 9 and the opening means 15 to be delivered by the dispensing opening 8.

However, because the conformation of the membrane to the raised element is limited before it is opened, the membrane can have an irregular opening: the opening can be irregularly distributed on the membrane surface in contact with the opening means, the membrane can be torn before it conforms to the opening means (so that the pressure drops and the beverage flows through an opening of the membrane having an unwished shape). The opening of the membrane can also be different from one capsule to another. This can change the quality or the taste of the prepared food product or beverage, because the pressure inside the chamber during the beverage preparation can change from one capsule to another, and because the filter function of the membrane and opening means can be modified. The filter function of the aluminium membrane is important to guarantee a good quality of the beverage, as it should maintain non-dissolvable products such as ground roast coffee within the capsule while letting the beverage flow. In particular, the aluminium membrane should properly covers passages formed in the pyramids of the opening means which may otherwise let pass undesired solid particles.

Figure 4A:
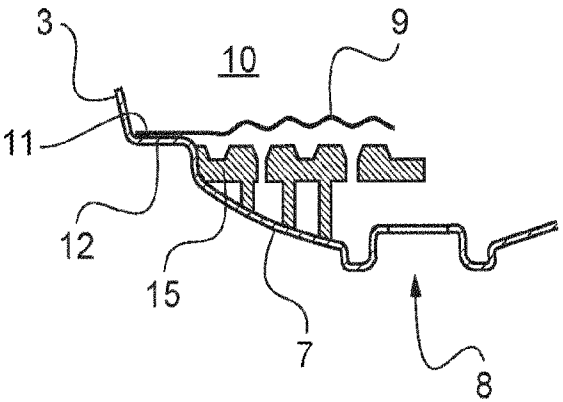
FIGS. 4*a* to 4*c* illustrate on similar views as those of FIGS. 3*a*-3*c* the behaviour of a membrane of a capsule according to an embodiment of the invention.
Figure 4B:
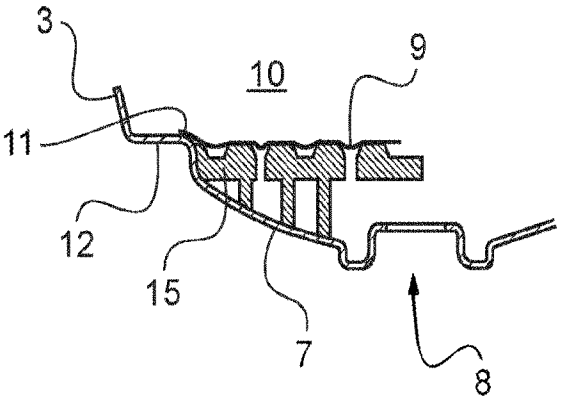
Figure 4C:
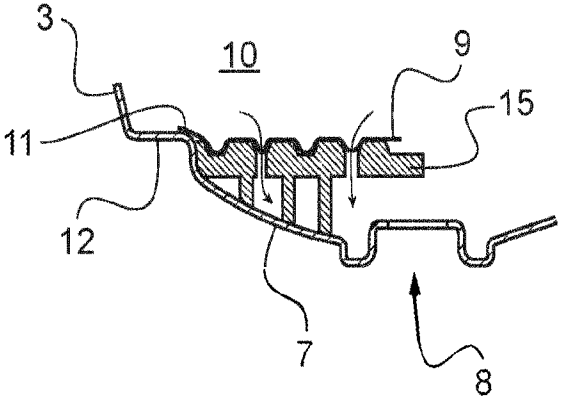

By way of comparison, FIGS. 4*a*, 4*b* and 4*c* illustrate the behaviour of a membrane of a capsule according to the invention when a food or beverage product is produced.

FIG. 4*a*, which represents the bottom end portion of a capsule for food or beverage preparation, before injection of fluid inside the chamber 10, is identical to FIG. 3*a*. This initial state is the same for a conventional prior-art capsule and a capsule according to the invention.

According to the present invention, the adhesive seal 11 used to attach the membrane 9 to the body 2 of the capsule and provide sealing between them has the following properties. When a given release pressure is established inside the chamber 10 the adhesive seal 11 allows the membrane to be displaced relatively to the body and to engage against the opening means while maintaining the sealing between the body and the membrane, as shown in FIG. 4*b*. In other words, the membrane remains fixedly attached to the rim 12 until the release pressure is reached inside the chamber 10. When this release pressure is established, the force applied to the surface of the membrane 9 which covers the opening surrounded by the rim 12 and caused by the pressure difference between the inside and the outside of the chamber cannot be sustained by the adhesive seal. The membrane is therefore displaced relative to the body to engage the opening means 15. In the state represented in FIG. 4*b*, the release pressure has been reached inside the chamber 10. As the fixation provided by the adhesive seal is not strong enough to sustain the force applied by the pressure inside the chamber 10 (provided that the pressure outside the capsule is atmospheric pressure), the periphery of the membrane attached to the rim 12 slides on said rim 12. This sliding movement can be obtained, depending on the desired release pressure, with an adhesive seal having a tear resistance comprised between 4N/15 mm and 12N/15 mm, measured according to ISO 1924/1 standard.

Thus, when a pressure higher than the release pressure is established inside the chamber 10 only the radially innermost part of the rim 12 remains covered by the membrane and attached to the periphery of the membrane. However, an attachment between the membrane 9 and the body 2 is maintained (i.e. between the membrane 9 and the rim 12 in the represented embodiment).

Despite the high stiffness of the material which forms the membrane 9, extra surface is so provided for conformation of the membrane to the shape of the raised elements 17 of the opening means (or, generally speaking, for conformation of the membrane to the shape of the opening means). Compared to the membrane of a prior-art capsule, the membrane 9 of a capsule according to the invention can enter deeper into the spaces 18 between the pyramidal raised elements 16. The conformation of the membrane to the shape of the opening means is more regular on the whole surface of the membrane.

As shown in FIG. 4*c*, the pressure rises in the chamber 10 with introduction of fluid until it reaches the opening pressure. The adhesive seal is thus configured so that the opening pressure is higher than the release pressure.

The membrane is pressed against the opening means by the force generated by the pressure difference between the pressure inside the chamber 10 and the atmospheric pressure outside said chamber 10. When the opening pressure is reached, the membrane opens (i.e. is pierced, cut, or torn) as shown in FIG. 4*c* thanks to the sharp design of raised elements 16 of the opening means 15. that create a mechanical lever effect onto the membrane, hence a mechanical stress in the membrane material until the latter reaches its mechanical failure point and tears or more generally breaks. This breaking of the material does not necessarily need to be in a plane perpendicular to the general plane of the membrane, but can also be in any other direction, and not necessarily throughout the whole thickness of the material, as long as a passage is created between the inside of the capsule and the outside, so as to allow product to flow from inside the capsule towards the outside. The food or beverage product obtained flows through the membrane 9 and the opening means 15 to be delivered by the dispensing opening 8.

Thanks to the better conformation of the membrane to the shape of the opening means, a regular opening can be obtained over the whole surface of the membrane in contact with the opening means. In the represented example embodiment, the membrane presents after opening evenly distributed openings formed by the top of each pyramidal opening element. This also results in a constant and thus more predictable pressure inside the chamber 10 when a food or beverage is prepared from one capsule to another. Lastly, a constant quality and taste of the product is provided.

An important aspect of the invention is the configuration of the adhesive seal. The configuration comprises the adhesive and mechanical properties (peel strength, shear strength) of the material used to form the seal, and its shape (thickness, surface, and more generally its dimensions, etc.).

The configuration of the adhesive seal and the surface area of the membrane to which the pressure inside the chamber of the capsule applies determine the release pressure.

The opening pressure depends on the beverage or food product to be prepared with a given capsule. A typical pressure adapted for coffee preparation is around 6-15 bar. The adhesive seal can be configured to provide a release pressure that is 1 to 10 bar under the opening pressure. For example, a release pressure of 5 bar can be chosen when the opening pressure is 6 bar or more, for example 13 bar.

The adhesive seal can for example have the following configuration, when the opening at the bottom end of the chamber which is covered by the membrane has a surface area of 600 $mm^2$. The adhesive seal is made of a heat seal lacquer. The sealed area is formed on a flat rim which directly surrounds said opening. The sealed area thus has a flat annular shape, and has a width of ca. 3.5 mm. For example, the thickness of the adhesive seal may be comprised between 5 and 20 micrometers.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for food or beverage preparation, the capsule comprising:

a hollow body and an injection wall, wherein the injection wall is impermeable to liquids and to gases and is attached to the hollow body and adapted to be punctured for fluid injection into the capsule, a chamber formed inside the hollow body containing an ingredient for preparing a food or beverage by dissolution with a fluid under pressure or extraction by the fluid under a preparation pressure, a membrane disposed at a bottom end of the chamber, for retaining internal pressure in the chamber, an opening member located outside the chamber, the opening member being configured to open the membrane when the membrane is pressed against the opening member under an opening pressure, and the membrane is attached to the hollow body of the capsule by a heat seal lacquer which, when a release pressure, less than the opening pressure, is established inside the chamber and applied to at least part of the surface of the membrane, is configured to allow a periphery of the membrane to slide on a rim of the hollow body and to engage against the opening member while maintaining an attachment between the hollow body and the membrane.

2. The capsule according to claim 1, wherein the configuration of the heat seal lacquer to allow the periphery of the membrane to slide under the release pressure is based at least on the following parameters: the adhesive seal composition, the adhesive seal contact area between the membrane and the hollow body of the capsule, and the area of the part of the membrane to which pressure applies when a pressure is established in the chamber.

3. The capsule according to claim 1, wherein the heat seal lacquer is composed of a polymer material or polymer materials.

4. The capsule according to claim 3, wherein the polymer material is selected from the group consisting of: polypropylene (PP), polystyrene (PS), polyethylene terephthalate (PET), and vinyl (PVC).

5. The capsule according to claim 1, wherein the heat seal lacquer has a tear resistance comprised between 4N/15 mm and 12N/15 mm, measured according to ISO 1924/1 standard.

6. The capsule according to claim 1, wherein the release pressure is set between 1 and 12 bar.

7. The capsule according to claim 6, wherein the opening pressure is 0.5 to 10 bar above the release pressure.

8. The capsule according to claim 1, wherein the material of which the membrane is made has a Young's modulus above 10 GPa.

9. The capsule according to claim 1, wherein the membrane is made of aluminium.

10. The capsule according to claim 1, wherein the opening member comprises a plate having an upper surface facing the membrane, and wherein the upper surface forms or carries sharp raised elements.

11. The capsule according to claim 10 wherein the raised elements are pyramids or truncated pyramids.

12. The capsule according to claim 1, wherein the material of which the chamber is formed from is selected from the group consisting of aluminium, aluminium/plastics composite, aluminium/plastics/paper composite, paper laminates, and plastics in a single layer or in a multilayer form.

13. The capsule according to claim 1, wherein the ingredient contained in the chamber comprises ground roast coffee to be extracted with water vapour and/or hot liquid water.

* * * * *